US007766538B2

(12) United States Patent
Conrad et al.

(10) Patent No.: US 7,766,538 B2
(45) Date of Patent: Aug. 3, 2010

(54) SYSTEM FOR BLENDING LIQUIDS IN SELECTED RATIOS

(75) Inventors: Steven S. Conrad, Rogers, AR (US); Daniel C. Brown, Rogers, AR (US)

(73) Assignee: Assembled Products Corporation, Rogers, AR (US)

( * ) Notice: Subject to any disclaimer, the term of this patent is extended or adjusted under 35 U.S.C. 154(b) by 795 days.

(21) Appl. No.: 11/523,178

(22) Filed: Sep. 19, 2006

(65) Prior Publication Data

US 2007/0064520 A1 Mar. 22, 2007

Related U.S. Application Data

(60) Provisional application No. 60/719,642, filed on Sep. 22, 2005.

(51) Int. Cl.
*B01F 15/02* (2006.01)

(52) U.S. Cl. ..... 366/152.6; 366/182.1

(58) Field of Classification Search ..... 366/160.1, 366/160.2, 160.3, 160.4, 182.1, 182.2, 182.3, 366/182.4, 142, 152.6, 152.1
See application file for complete search history.

(56) References Cited

U.S. PATENT DOCUMENTS

| | | | | | |
|---|---|---|---|---|---|
| 2,900,176 | A * | 8/1959 | Krogel | ..... | 366/162.1 |
| 3,877,682 | A * | 4/1975 | Moss | ..... | 366/182.4 |
| 4,573,802 | A * | 3/1986 | Kerrigan et al. | ..... | 366/152.1 |
| 4,614,438 | A * | 9/1986 | Kobayashi | ..... | 366/152.1 |
| 4,621,927 | A * | 11/1986 | Hiroi | ..... | 366/132 |
| 5,308,160 | A * | 5/1994 | Weiss | ..... | 366/152.1 |
| 5,833,364 | A * | 11/1998 | Rushing et al. | ..... | 366/152.1 |
| 5,935,332 | A * | 8/1999 | Caucal | ..... | 366/160.2 |
| 5,980,836 | A * | 11/1999 | Moffett et al. | ..... | 366/160.2 |
| 6,203,183 | B1 * | 3/2001 | Mordaunt et al. | ..... | 366/152.1 |
| 7,384,183 | B2 * | 6/2008 | Smith | ..... | 366/162.1 |
| 7,461,968 | B2 * | 12/2008 | Demers et al. | ..... | 366/152.1 |

* cited by examiner

*Primary Examiner*—Tony G Soohoo
(74) *Attorney, Agent, or Firm*—Boyd D. Cox

(57) ABSTRACT

A system that consistently blends together liquids at a specified ratio to create a particular resultant chemical solution stops operating and notifies an operator when the level of one of the supplied liquids is low. This ensures that the proper ratio of blended liquids will be maintained during operation of the system.

22 Claims, 2 Drawing Sheets

SYSTEM FOR BLENDING LIQUIDS IN SELECTED RATIOS

Priority for this application is claimed from U.S. Provisional Application No. 60/719,642 entitled "System for Blending Liquids In Selected Ratios" filed on Sep. 22, 2005

BACKGROUND

The present invention is directed to a system that consistently blends together liquids at a specified ratio to create a particular chemical solution. When the level of one of the supplied liquids is low and needs to be replenished, the system stops operating and notifies an operator. The system ensures that the proper ratio of blended liquids will be maintained during operation of the system.

Cleaning standards for commercial kitchens generally require that dishes, cookware, and work areas be cleaned according to specifications using solutions that comprise particular strengths of cleaning agents. These solutions are generally mixed on site from chemical concentrates and water. The particular strength of the resultant solution is dependent on the ratio of the mix of water to chemicals.

Various devices are known in the prior art that blend the solutions in selected proportions. Depending on the blend proportions and chemicals used, the resultant solutions can be used for various purposes, including cleaning, degreasing, and sanitizing. However, these prior art devices have several drawbacks.

The proper proportion of the blended water and chemical is dependent on a constant flow of water. Since the flow of water can fluctuate with the incoming water pressure, the proper ratio of water and chemicals may not be consistent, resulting in a solution that is weaker or stronger than the desired concentration. If the proportion is too weak, it can result in the solution being below sanitation standards which can create health problems. If the proportion is too high, the solution becomes a contaminate and waste occurs, thereby increasing operating costs.

Additionally in the prior art, the concentrated chemicals for blending are stored and released right on location in the kitchen work area. Not only do the stored chemicals take up valuable space in the work area, it could be unsafe to keep concentrated chemicals in areas where food is located.

Since excess space for storing the chemical is required in the kitchen work area where space is usually at a premium, smaller containers of the chemicals are typically used by the prior art devices. The smaller containers must be changed frequently requiring the operator's time and attention that could be better spent elsewhere in the kitchen. Furthermore, as the chemical containers become empty, the system will continue to operate with decreasing amounts of chemical being blended with the water, thereby creating a weakened solution. It is incumbent upon the operator to see that the chemical levels in the container are low and to manually stop operation of the system and replenish the chemical container. Otherwise, the system will continue to operate releasing an inferior, resultant solution with little or no chemical being added to the water. Such an oversight can lead to health concerns if the strength of the solution is not up to standards. The cleaning, degreasing or sanitizing operation performed using an inferior solution must be repeated after replenishing the depleted chemical, thereby increasing the workload of the operator and increasing the amount of time required for the task.

Consequently, it is important that the proper ratio of water to chemical be maintained when blending the solution to ensure that standards of safety and hygiene are met.

When one of the chemicals runs out, when there is a loss of electrical power or when there is loss of potable water with which to mix the chemicals, most blending systems will continue to operate using disproportionate ratios of water to chemical. This can be hazardous when there is no indication that the ratio of the solution being dispensed is no longer the correct ratio for the chemical solution.

There is a need for a system that can consistently blend liquids in a pre-selected ratio, whereby the system is disabled and blending of the solution is halted when the supply of one of the liquids is low. In addition, there is a need for a system that notifies the operator when the level of one of the supplied liquids is low and the system has been disabled.

Generally, accurate chemical solution proportioning can also be dependent on the incoming water pressure. The water pressure can at times be variable and difficult to control resulting in disproportionate chemical mixtures.

There is also a need for a blending system that maintains the correct ratio of mixed liquids regardless of fluctuations in the water pressure. In addition, there is a need for a blending system for mixing chemical concentrates in water that allows the chemical concentrate to be maintained in large, bulk quantities at a location away from the work area where the resultant mixture is used.

SUMMARY

The blending system of the present invention comprises a solution mixing device, a chemical supply device and a control box for operating the solution mixing device and the chemical supply device. A plurality of hoses accommodates the flow of liquid into the system, within the system and out of the system. The solution mixing device comprises an electrical solenoid valve that is controlled by a chemical monitoring system. The electrical solenoid valve controls the inflow of the water to the proportioning pump. When the chemical supply is low or when electrical power is lost, the solenoid valve is closed to shut off flow of the water supply. A water proportioning pump receives the flow of water as controlled by the solenoid valve. A chemical pump injects the chemical into the water flow in the water proportioning pump. A piston disposed above the chemical pump maintains the correct flow rate of chemical used for blending despite the incoming water pressure. The chemical monitoring system is located in the chemical supply container and disables the solution mixing device when the level of chemicals in the supply container is depleted to a certain level.

It is an object of the present invention to provide a blending system for producing chemical solution that stops operating when the chemical supplied to the system for blending becomes low.

It is a further object of the present invention to provide a solution mixing device in a blending system that maintains a specified solution mix rate through the device despite changes in the water pressure and/or flow rate of the incoming water.

It is a further object of the present invention to provide a blending system having an indicator means that signals an operator when the system has been disabled.

It is a further object of the present invention to provide a blending system having an indicator means that signals an operator when the supplied chemical level is low.

It is a further object of the present invention to provide a blending system with a solution mixing device wherein the proportions of water to chemical can be selectively adjusted.

It is a further object of the present invention to provide a blending system in which the supply of chemicals can be kept in a location remote from the work area where the resultant solution is released and used.

It is a further object of the present invention to provide a system for producing a chemical solution with a consistent concentration.

It is a further object of the present invention to provide a system for producing a cleaning solution with a consistent concentration.

It is a further object of the present invention to provide a system for producing a sanitizing solution with a consistent concentration.

It is a further object of the present invention to provide a system for producing a degreasing solution with a consistent concentration.

It is a further object of the present invention to provide a solution mixing device that can maintain the correct proportion of chemical to water in the solution that is produced and released.

It is a further object of the present invention to provide a solution mixing device that can deliver the correct proportion of chemical to water in the solution that is produced and released to multiple locations.

BRIEF DESCRIPTION OF DRAWING

Reference is made to the accompanying drawings in which are shown illustrative embodiments of the invention and from which novel features and advantages will be apparent.

DETAILED DESCRIPTION

Figure 1:
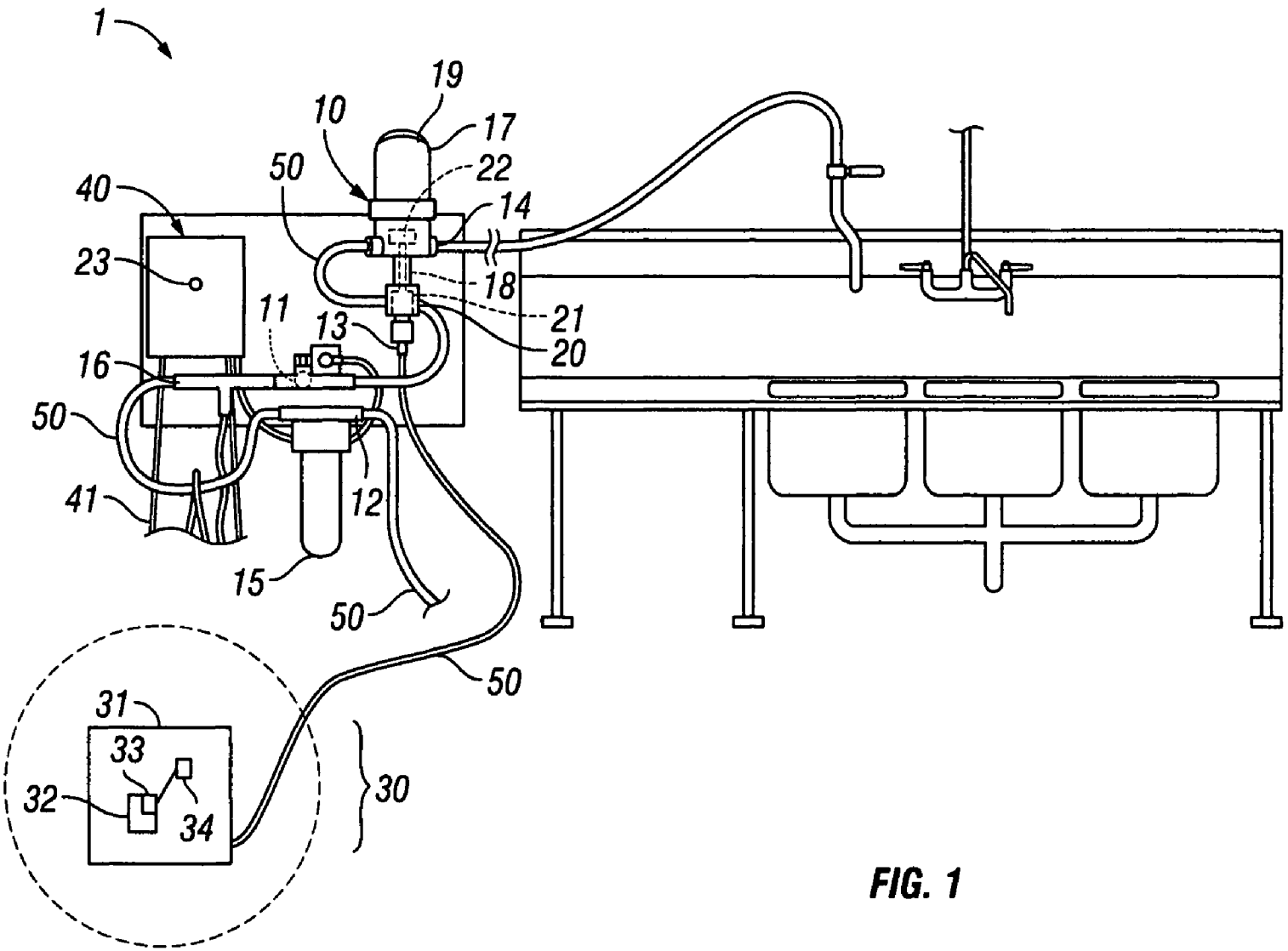
FIG. 1 is a blending system of a preferred embodiment of the present invention installed in a kitchen with the inset showing a schematic of the chemical supply device.
Figure 2:
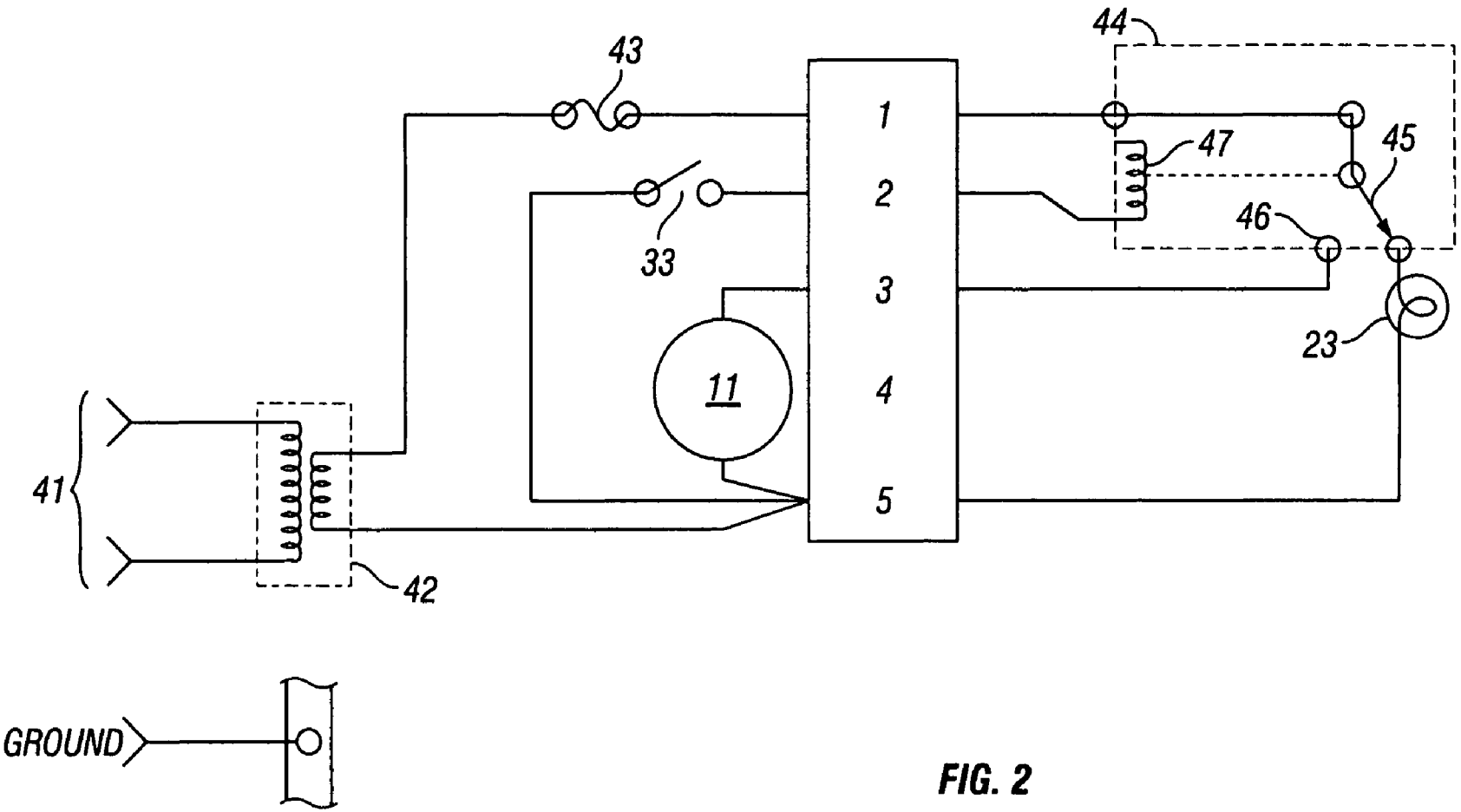
FIG. 2 is an operational diagram of the blending system of FIG. 1.

As shown in FIGS. 1 and 2, the blending system 1 of a preferred embodiment of the present invention comprises a solution mixing device 10, a chemical supply device 30 and a control box 40 that operates the solution mixing device 10 and the chemical supply device 30. A plurality of hoses 50 accommodate the flow of water and chemicals into and out of the system in addition to flow within the system.

The solution mixing device 10 includes a water entry port 12, a chemical entry port 13 and a solution release port 14. The solution mixing device 10 further comprises an electrical solenoid valve 11, a water filter 15, a backflow preventer 16, a water proportioning pump 17, and a chemical pump 21.

The water proportioning pump 17 has a lower portion 18 and an upper portion 19 and means for adjusting the water to chemical ratio which comprises a ratio adjustment mechanism 20. The chemical pump 21 has a piston 22.

The chemical supply device 30 includes a chemical supply container 31 and a chemical monitoring system. The chemical monitoring system is a liquid level switch assembly 32 which comprises a liquid level switch 33 having a float 34.

The control box 40 comprises a level indicator light 23, a power input source 41, a transformer 42, a circuit breaker 43 and a relay 44. The relay includes a coil 47, a first contact 45 which is normally closed and a second contact 46 which is normally opened. The level indicator light 23 provides means for indicating a low liquid level in the liquid supply container.

In a preferred embodiment, the power input source 41 comprises an electrical power cord and the transformer 42 is a 40-watt transformer that converts the incoming power source to 24 VAC operating power. The circuit breaker 43 is a 3-amp circuit breaker while the relay 44 is preferably a single pole double throw 24 VAC relay.

In the solution mixing device 10, the water entry port 12 transports incoming, potable water into the solution mixing device 10. The chemical entry port 13 transports incoming chemicals into the solution mixing device 10. After the water and chemicals are mixed into solution in the solution mixing device 10, the solution is released for use from the mixing device 10 through the solution release port 14.

The water filter 15 removes particulates from the incoming potable water to prolong the life of the blending system 1. The backflow preventer 16 deters the filtered water from flowing back into the unfiltered potable water supply in order to prevent contamination.

The electrical solenoid valve 11 provides means for controlling the flow of water through the water proportioning pump 17 which controls the proportional amount of chemical to be mixed with the water to produce the solution. Also, the water and chemicals are mixed within the water proportioning pump 17 to create the solution which is released for use.

The chemical pump 21 inputs a selected amount of chemicals into the water passing through the water proportioning pump 17 to produce the proper proportion of concentration for the resultant solution.

Within the chemical pump 21, the piston 22 drives the chemical pump 21 and assists in maintaining the proper ratio of water to chemicals despite fluctuations in the flow rate of the incoming water.

The means for adjusting the water to chemical ratio comprises the ratio adjustment mechanism 20. The ratio adjustment mechanism 20 is actuated by rotating it relative to the upper portion 19 of the water proportioning pump 17. This varies the stroke length of the chemical pump 21 which adjusts the volume of chemical pumped. Preferably, the ratio of water to chemicals ranges from about 500:1 to about 25:1 and depends on the stroke of the chemical pump 21. Other ratios may be formulated, if desired.

The liquid level switch assembly 32 monitors the level of chemicals contained in the chemical supply container 31. When the level drops below a certain point, the liquid level switch assembly 32 activates the level switch 33 to open and thereby stops operation of the system 1.

The liquid level switch 33 controls operations of the solution mixing device 10 so that it can stop the system 1 from blending and releasing the mixed solution. The liquid level switch 33 also initiates activation of the level indicator light 23.

The float 34 on the liquid level switch 33 monitors the surface level of the chemical present in the chemical supply container 31. The float 34 signals the liquid level switch 33 when the chemical's level drops below a specified height, indicating that the chemical needs to be replenished in the supply container 31.

The level indicator light 23 is activated when the liquid level switch 33 is opened and notifies the operator when the chemical level is low in the chemical supply container 31 and needs to be replenished.

The water proportioning pump 17 has an upper portion 19 and a lower portion 18. The lower 18 and upper 19 portions can be rotated relative to each other. The piston 22 is contained within the upper portion 19. The chemical pump 21 is disposed in the lower portion 18 below the piston 22.

The liquid level switch assembly 32 is contained within the chemical supply container 31. Liquid level switch 33 is installed and rests at, or near the bottom of the chemical supply container 31. The float 34 is attached to the liquid level switch 33 and is free to ride up and down with the surface level of the liquid in the chemical supply container 31.

The chemical supply container 31 and solution mixing device 10 can be maintained at a location remote from the area of use. This arrangement allows for the chemical supply container 31 and solution mixing device 10 to be kept in a secure location, thereby discouraging tampering, while simultaneously preventing unwanted contact between concentrated chemicals and items such as food products.

The electrical solenoid valve 11 has opened and closed valve positions. In the opened valve position, the water is allowed to flow through the water proportioning pump 17 and be mixed with the chemical to produce the resultant solution. In the closed valve position, the electrical solenoid valve 11 blocks the water from flowing through the water proportioning pump 17 and thereby disables operation of the system 1. Consequently, the electrical solenoid valve 11 is maintained in the opened valve position during operation.

When the chemical level of the chemical supply container 31 is low, the electrical solenoid valve 11 is deactivated to move into the closed valve position to block water flow through the water proportioning pump 17. With the loss of electrical power, the electrical solenoid valve 11 is also moved to the closed valve position and water flow is blocked through the water proportioning pump 17.

The liquid level switch 33 alternates between an opened switch position and a closed switch position. In the closed switch position the liquid level switch 33 allows the blending system 1 to produce and release the resultant solution. When the liquid level switch 33 is in the opened switch position, the system 1 is disabled, whereby the solution is not produced.

The first 45 and second 46 contacts in the relay 44 have respective first and second opened positions and respective first and second closed positions. When closed, the first contact 45 activates the level indicator light 23. When opened, the first contact 45 does not allow power to flow to the level indicator light 23, and the light 23 is not activated.

When opened, the second contact 46 allows the electrical solenoid valve 11 to close, thereby disabling the operation of the system 1. When closed, the second contact 46 activates the electrical solenoid valve 11 to open, thereby allowing the water to flow through the water proportioning pump 17.

The blending system 1 of the present invention can be used for different purposes. In one preferred use, the blending system 1 is used for cleaning, wherein the system 1 produces and releases a cleaning solution. Therefore, a chemical concentrate for cleaning is placed in the chemical supply container for blending with water. In a second preferred use, a sanitizing solution can be produced by the blending system 1 which is used for sanitizing. A chemical concentrate for sanitizing is mixed by the system 1 with water. In a third preferred use, the system 1 can be used for degreasing. With this third preferred use, a degreasing solution is produced and released by the blending system. A chemical concentrate for degreasing is placed in the chemical supply container for mixing with water. It is recommended that a separate system 1 be installed for each of the preferred uses in which different types of chemical concentrates are blended.

In use, the blending system 1 mixes incoming potable water with incoming chemicals to create a solution that is in accordance with a specified proportion. The resultant solution is then released as needed. When the supply of chemicals is low or exhausted or electrical power is lost, the system 1 is disabled and production of the solution is interrupted so that the chemical supply can be replenished or the power restored. Once the chemical supply is replenished or the power is restored, operation of the system 1 can be resumed.

Specifically, when the system 1 is operating, potable water enters the water entry port 12 of the solution mixing device 10 and passes through the water filter 15. The water filter 15 removes particulate matter from the water. The filtered water then passes through the backflow preventer 16 which deters the filtered water from flowing back into the incoming unfiltered water. From the backflow preventer 16, the water flows into the electric solenoid valve 11 and then the water proportioning pump 17. At such time, there is full electrical power to run the system and there is an adequate level of chemical in the supply container.

In the water proportioning pump 17, the chemical is mixed into the incoming water by the chemical pump 21. The reciprocating action of the piston 22 in the upper portion 19 of the water proportioning pump 17 drives the chemical pump 21 to move the chemical from the chemical supply container 31 and into the water proportioning pump 17. The stroke of the chemical pump 21 determines the specific water to chemical ratio. By turning the ratio adjustment mechanism 20 of the water proportioning pump 17 relative to the upper portion 19, the pump stroke can be adjusted to the desired length of stroke and the proportion of chemical entering the water flow can be set.

Meanwhile, the liquid level switch assembly 32 of the chemical monitoring system in the chemical supply container 31 is continuously checking the level of the chemical present in the chemical supply container 31. The float 34 on the liquid level switch 33 rides proximate the surface level of the chemical liquid in the supply container 31. As the level of the chemical changes within the supply container 31, the float 34 moves in direct relationship with the surface level as it varies in the supply container 31.

When the level of the chemical in the chemical supply container 31 drops below a certain point, indicating the need to replenish the chemical, the float 34 drops with the level and activates the liquid level switch 33 to open. With the liquid level switch 33 opened, the system 1 is disabled, and the solution is no longer produced and released from the solution release port 14 for use.

More particularly, when the chemical in the supply container 31 drops below a certain pre-selected level and needs replenishing, the float 34 activates the liquid level switch 33 to open as indicated above. The opened liquid level switch 33 removes power from the coil 47 in the relay 44 of the control box 40. With the coil 47 de-energized (not receiving power), the second contact 46 is opened, thereby interrupting power flow to the electrical solenoid valve 11. This interruption of power to the solenoid valve 11 causes the valve 11 to close. Closing of the solenoid valve 11 stops water flow through the water proportioning pump 17. Simultaneously, the first contact 45 is closed, thereby allowing power to flow to the indicator light 23. The power illuminates the indicator light 23, which is intended to notify an operator that the amount of chemical in the supply container 31 is depleted and that the system's operations have ceased.

When the chemical in the chemical supply container 31 is replenished to a level above a pre-selected level or a replacement container 31 with adequate chemical supply is utilized and the liquid level switch assembly 32 is placed therein, the float 34 rises and closes the liquid level switch 33 within the supply container 31. The closed liquid level switch 33 gives power to the coil 47 in the relay 44 of the control box 40 and the second contact 46 is closed. The closed second contact 46 allows power to flow to the solenoid valve 11 resulting in the solenoid valve 11 opening. The opened solenoid valve 11 allows water to flow through the water proportioning pump 17. With the water flowing through the water proportioning pump 17, the solution mixing device 10 is allowed to mix the water and chemical and to release the resultant solution in correct proportion with the pre-selected ratio of water to chemical. Simultaneously, the first contact 45 is opened, thereby cutting power flow to the indicator light 23. Without power, the indicator light 23 is not illuminated, indicating that an adequate level of chemical is in the supply container 31.

Consequently, the level of the chemical in the chemical supply container 31 determines the operation of the system 1 so that when the chemical supply becomes low, the system automatically stops operating and the operator is informed that the supply of chemical needs to be replenished.

Since the system shuts down when the chemical supply level becomes low, the present invention insures that the system will not continue to produce and release a solution with incorrect proportions. Therefore, the system provides a more reliable solution that can be used for cleaning, degreasing, sanitizing, or other function for which a controlled solution might be needed.

The system also enables the chemicals used in the solutions to be maintained in bulk form at a location remote from where the solutions are used. This keeps from having to use valuable space in the work area to hold the chemicals and further keeps from having to store concentrated chemicals in the area where the solutions are typically used.

In an alternate preferred embodiment, multiple blending systems can be used together to provide multiple desired results. For example, a pair of blending systems of the present invention could provide an operation for degreasing and sanitizing. In such operation, one system would include a degreasing chemical concentrate for blending with water and the other system would include a sanitizing chemical concentrate for blending with water. Any desired number of systems can be used together and the chemicals varied to achieve the desired results.

Although the present invention has been described in considerable detail with reference to certain preferred versions thereof, other versions are possible. Therefore, the spirit and scope of the appended claims should not be limited to the description of the preferred versions contained herein. It should be appreciated that the blending system of the present invention can be used in various environments other than those presented herein and different types of chemical concentrates can be used with the system.

The invention claimed is:

1. A system for blending liquids in selected ratios to create a particular resultant solution, the system for blending liquids comprises:

a solution mixing device in which the liquids are blended;

a chemical supply device; and a control box for operating the solution mixing device;

said system further comprises an operating mode and a disabled mode;

said solution mixing device further comprises a water proportioning pump, a valve for controlling an on/off flow of water through the water proportioning pump, and a chemical pump which inputs a selected amount of chemicals into the water within the water proportioning pump;

said valve includes an open valve position and a closed valve position; wherein when said valve is in the open valve position, the water is allowed to flow through the water proportioning pump, and when said valve is in the closed valve position, the water is blocked from flowing through the water proportioning pump;

wherein said chemical pump includes a piston disposed within the water proportioning pump and maintains a selected ratio of water to chemicals while the system is in said operating mode.

2. The system for blending liquids of claim 1, wherein said water proportioning pump further comprises means for adjusting the water to chemical ratio.

3. The system for blending liquids of claim 1, wherein said solution mixing device comprises:

a water filter for removing particulates from water entering the system;

a backflow preventer which deters water that has passed through the water filter from flowing back into the unfiltered water.

4. The system for blending liquids of claim 1, wherein said solution mixing device further comprises:

a water entry port which transports incoming water into the solution mixing device;

a chemical entry port which transports incoming chemicals into the solution mixing device; and a solution release port which releases the resultant solution from the system.

5. The system for blending liquids of claim 1, wherein said chemical supply device comprises:

a chemical supply container; and a chemical monitoring system.

6. The system for blending liquids of claim 5, wherein said chemical monitoring system comprises a liquid level switch assembly that monitors the level of the chemical in the chemical supply container and controls operation of the solution mixing device.

7. The system for blending liquids of claim 6, wherein said control box comprises:

means for indicating a liquid level in the chemical supply container.

8. The system for blending liquids of claim 7, wherein said means for indicating a liquid level in the chemical supply container comprises a level indicator light.

9. The system for blending liquids of claim 8, wherein when the liquid level in the chemical supply container drops to a pre-selected level, said liquid level switch assembly actuates said level indicator light and disables the system.

10. The system for blending liquids of claim 6, wherein said control box includes a level indicator for monitoring the level of the chemical disposed in the chemical supply container.

11. The system for blending liquids of claim 10, wherein said level indicator comprises a light that is activated when the level of the chemical in the chemical supply container drops below a pre-selected level.

12. The system for blending liquids of claim 11, wherein said liquid level switch assembly comprises:

a liquid level switch; and a float.

13. The system for blending liquids of claim 12, wherein said float rides on the surface of the chemical disposed in the chemical supply container and activates the liquid level switch.

14. The system for blending liquids of claim 13, wherein said liquid level switch further actuates the valve between said closed and opened valve positions;

when said valve is in said closed valve position the system is in the disabled mode; and when said valve is in the opened valve position the system is in the operating mode.

15. The system for blending liquids of claim 14, wherein said liquid level switch is activated by said float between an opened switch position and a closed switch position;

when said liquid level switch is in said closed switch position, said system is in said operating mode; and when said liquid level switch is in said opened switch position, said system is in said disabled mode.

16. The system for blending liquids of claim 15, wherein when the level of the chemical in the chemical supply container drops below a pre-selected level, said liquid level switch moves to said opened switch position, the level indicator light is activated, the valve moves to a closed valve position and the system moves into the disabled mode.

17. The system for blending liquids of claim 1, wherein said solution mixing device further comprising a ratio adjustment mechanism.

18. The system for blending liquids of claim 17, wherein said water proportioning pump includes:

an upper portion; and a lower portion;

said solution mixing device further comprises a chemical pump which inputs a selected amount of chemical with the water.

19. The system for blending liquids of claim 18, wherein said ratio adjustment mechanism is rotatably attached to said upper portion.

20. The system for blending liquids of claim 19, wherein the ratio of water to chemicals input by the chemical pump is selectively adjusted by rotating the ratio adjustment mechanism relative to the upper portion.

21. A system for blending liquids in selected ratios to create a particular resultant solution, the system for blending liquids comprises:

(1) a solution mixing device;

(2) a chemical supply device;

(3) a control box for operating the solution mixing device;

wherein said system further comprises an operating mode and a disabled mode;

(1) said solution mixing device includes:

a water proportioning pump;

a water entry port which transports incoming water into the solution mixing device;

a chemical entry port which transports incoming chemicals into the solution mixing device;

a solution release port which releases the resultant solution from the system;

a water filter for removing particulates from the incoming water;

a backflow preventer which deters water that has passed through the water filter from flowing back into unfiltered water;

a chemical pump which inputs a selected amount of chemicals into the water proportioning pump; and a solenoid valve disposed between the backflow preventer and the water proportioning pump;

said solenoid valve having an opened valve position and a closed valve position;

wherein when said solenoid valve is in the opened valve position, the water is allowed to flow through the water proportioning pump, and when said solenoid valve is in the closed valve position, the water is blocked from flowing through the water proportioning pump;

(2) said chemical supply device includes:

a chemical supply container; and a liquid level switch assembly that monitors the level of the liquid in the chemical supply container and controls operation of the solution mixing device;

(3) said control box includes:

a level indicator light;

a first contact; and a second contact;

wherein said level indicator light is activated when the liquid level in the chemical supply container drops below a pre-selected level;

wherein said first contact includes first opened and closed positions, and said second contact includes second opened and closed positions;

said water proportioning pump includes:

a lower portion;

an upper portion; and a ratio adjustment mechanism rotatably attached to the upper portion;

wherein the ratio of water to chemicals is adjusted by rotating the ratio adjustment mechanism relative to the upper portion;

said chemical pump comprises a piston disposed within said upper portion of said water proportioning pump;

said liquid level switch assembly is disposed in the chemical supply container and comprises:

a liquid level switch; and a float which monitors a surface level of the liquid in the chemical supply container;

wherein said float rides on the surface of the chemical in the chemical supply container and actuates the liquid level switch based on the level of the chemical in the chemical supply container;

wherein said liquid level switch has an opened switch position and a closed switch position; when said system is in said operating mode, said liquid level switch is in said closed switch position; and when said system is in said disabled mode, said liquid level switch is in said opened switch position;

when the system is in the operating mode, the solenoid valve is in the opened valve position and water is flowing through the water proportioning pump, the first contact is in said first opened position, the second contact is in the second closed position and the level indicator light is deactivated;

when the level of the chemical in the chemical container drops below a pre-selected level, said float signals the liquid level switch to move from the opened switch position to the closed switch position, the level indicator light is activated, the first contact moves to the first closed position, and the second contact moves to said second opened position, said solenoid valve moves to the closed valve position to cut off flow of water through the water proportioning pump, and the system moves into the disabled mode.

22. The system for blending liquids of claim 21, wherein said selected ratio of water to chemicals ranges from approximately 500:1 to approximately 50:1.

* * * * *